US008678911B2

(12) United States Patent
Baltz et al.

(10) Patent No.: US 8,678,911 B2
(45) **Date of Patent: *Mar. 25, 2014**

(54) INTERFACE FOR A GAMING MACHINE

(75) Inventors: Frederick Van Baltz, Las Vegas, NV (US); Stephanie Maddocks, Las Vegas, NV (US); Michael H. D'Amico, Las Vegas, NV (US); Alan G. Sheldon, North Las Vegas, NV (US); Lori J. McDermeit, Las Vegas, NV (US); J. Christopher McNamee, Las Vegas, NV (US)

(73) Assignee: Aristocrat Technologies, Inc.

( * ) Notice: Subject to any disclaimer, the term of this patent is extended or adjusted under 35 U.S.C. 154(b) by 538 days.

This patent is subject to a terminal disclaimer.

(21) Appl. No.: 12/323,230

(22) Filed: Nov. 25, 2008

(65) Prior Publication Data

US 2009/0275397 A1 Nov. 5, 2009

Related U.S. Application Data

(63) Continuation-in-part of application No. 11/073,909, filed on Oct. 19, 2000, now Pat. No. 7,704,143, which is a continuation of application No. 09/960,696, filed on Sep. 21, 2001, now Pat. No. 6,896,619, which is a continuation of application No. 09/693,183, filed on Oct. 19, 2000, now Pat. No. 6,676,515.

(51) Int. Cl.
*A63F 9/24* (2006.01)

(52) U.S. Cl.
USPC ..... 463/25; 463/42

(58) Field of Classification Search
USPC ..... 463/42, 25–30, 16–25
See application file for complete search history.

(56) References Cited

U.S. PATENT DOCUMENTS

| | | | | |
|---|---|---|---|---|
| 5,839,956 | A | 11/1998 | Takemoto | |
| 5,851,149 | A * | 12/1998 | Xidos et al. | 463/42 |
| 6,048,269 | A * | 4/2000 | Burns et al. | 463/25 |
| 6,306,035 | B1 * | 10/2001 | Kelly et al. | 463/25 |
| 6,394,907 | B1 * | 5/2002 | Rowe | 463/42 |
| 6,500,067 | B1 | 12/2002 | Luciano et al. | |
| 6,676,515 | B1 | 1/2004 | Baltz et al. | |
| 6,682,421 | B1 * | 1/2004 | Rowe et al. | 463/25 |

(Continued)

FOREIGN PATENT DOCUMENTS

| | | |
|---|---|---|
| AU | 5574601 | 11/2001 |
| AU | 2002334685 C1 | 4/2003 |
| AU | 2007203606 B2 | 8/2007 |
| CA | 2331244 | 7/2001 |

OTHER PUBLICATIONS

Examiner's First Report corresponding to Australian Patent Application No. AU2002334685, 1 page, Jan. 4, 2007.

(Continued)

*Primary Examiner* — Masud Ahmed
(74) *Attorney, Agent, or Firm* — McAndrews, Held & Malloy, Ltd.

(57) ABSTRACT

An apparatus for use with a gaming machine is disclosed. The apparatus comprises an electronic processing board that is coupled to first and second data interfaces as well as a ticket printer. The electronic processing board responds to a cashout signal by communicating with the gaming machine via the first data interface, communicating with a computer system via the second data interface, and communicating with the printer to issue a ticket.

9 Claims, 3 Drawing Sheets

(56) References Cited

U.S. PATENT DOCUMENTS

| | | | | |
|---|---|---|---|---|
| 6,942,574 | B1 * | 9/2005 | LeMay et al. | 463/41 |
| 2001/0049303 | A1 * | 12/2001 | Found et al. | 463/42 |
| 2002/0128059 | A1 | 9/2002 | Baltz et al. | |

OTHER PUBLICATIONS

Examiner's Report No. 2 corresponding to Australian Patent Application No. AU2002334685, 2 pages, Feb. 28, 2007.

Communication pursuant to Article 96(2) EPC corresponding to European Patent Application No. EP02800365.5-2218, 3 pages, Jul. 26, 2005.

Communication with Supplementary European Search Report corresponding to European Patent Application No. EP02800365.5-2218, 3 pages, Dec. 29, 2004.

Communication pursuant to Article 94(3) EPC corresponding to European Patent Application No. EP06021889.8-2218, 3 pages, Mar. 3, 2009.

Communication with extended European Search Report corresponding to European Patent Application No. EP06021889.8-2218, 5 pages, Jul. 13, 2007.

International Search Report corresponding to International Application No. PCT/US02/30571, 1 page, mailed Dec. 18, 2002.

Office Action dated Jul. 12, 2012 of USPTO U.S. Appl. No. 11/946,618, filed Nov. 28, 2007, 13 pages.

* cited by examiner

200

INTERFACE FOR A GAMING MACHINE

RELATED APPLICATIONS

The present application is a continuation-in-part of U.S. application Ser. No. 11/073,909 filed Oct. 19, 2000, which is a continuation of U.S. application Ser. No. 09/960,696 filed Sep. 21, 2001 (U.S. Pat. No. 6,896,619) which, in turn, is a continuation of U.S. Ser. No. 09/963,183 filed Oct. 19, 2000 (U.S. Pat. No. 6,676,515).

FIELD OF THE INVENTION

The present invention relates generally to a gaming system and, more particularly, to retrofitting a gaming machine or gaming network.

BACKGROUND OF THE INVENTION

Gaming machines, particularly slot machines, have in recent years become one of the more popular, exciting, and sophisticated wagering activities available at casinos and other gambling locations. At the same time, slot machines have also become a source of greater revenue for gaming establishments.

Typically, a player, when finished playing, "cashes out" at the slot machine by activating a cash out button. At that time, the slot machine converts the amount of credits pending in the slot machine to a currency payout that is dispensed (e.g., as coins) to the player. The player must then collect all of the coins, fill a cup or pockets, then move to the next slot machine and re-enter all of the coins. Thus, the prior payout techniques tended to interrupt gameplay, thereby reducing profits and also reducing the excitement and entertainment experience that arises from uninterrupted game play.

In the past, slot machines have attempted to address the interruption caused when a player collects coins and moves to another slot machine. In particular, some slot machines have issued paper tickets that encode the amount of credit pending in the slot machine when the player presses the cashout button. The player may then simply pick up the ticket dispensed by the slot machine and proceed to a new slot machine without incurring the time delay and distraction associated with collecting currency and reinserting it into the new slot machine.

Successful ticketing, however, requires a comprehensive system level approach to ensure that the tickets are secure (e.g., they cannot be duplicated and reused, they cannot be forged, and the like), that as many slot machines as possible can accept tickets, and that ticketing does not cause as much interruption as the coin/currency payout that the tickets are designed to replace. However, in prior ticketing systems for example, the slot machines typically had to spend the time and processing resources to generate their own ticket validation numbers, or had to incur the delay of requesting a ticket validation number from a central authority each time the slot machine needed to print a ticket. As a result, prior slot machines exposed the player to unnecessary processing delay, thereby slowing play, and reducing the overall level of player enjoyment.

In addition, preexisting gaming machines do not have the capability to print and redeem tickets, making them apparently obsolete in a ticket environment. A player having received a printed ticket from one gaming machine, crosses the casino floor only to find that the next machine of choice is unable to redeem the ticket. This causes player frustration and potential confusion as to the purpose of the ticket.

SUMMARY OF THE INVENTION

According to an aspect of the invention there is provided an apparatus for use with a gaming machine, the apparatus comprising:

an electronic processing board;

a first data interface that is electrically coupled to the electronic processing board;

a second data interface that is electrically coupled to the electronic processing board; and a ticket printer that is electrically coupled to the electronic processing board, wherein the electronic processing board is arranged to perform the following steps in response to a cashout signal:

communicate with the gaming machine via the first data interface in order to effect a removal of wagerable credits from the gaming machine;

communicate with a computer system, which is remote to the gaming machine, via the second data interface so as to: provide the computer system with details of the removal of wagerable credit; and receive from the computer system ticket data that is associated with the removal of wagerable credits; and communicate with the ticket printer in order to cause the ticket printer to issue a ticket that associated with the ticket data.

In an embodiment of the invention the apparatus further comprises a visual display that is electrically coupled to the electronic processing board, wherein the electronic processing board is arranged to communicate with the visual display to display information in response to the cashout signal.

In an embodiment of the invention the electronic processing board is arranged to receive the cashout signal from the gaming machine via the first data interface.

In an embodiment of the invention the electronic processing board is arranged to use a predefined electronic funds transfer protocol in order to communicate with the gaming machine via the first data interface to effect the removal of wagerable credits from the gaming machine.

In an embodiment of the invention the apparatus further comprises a memory storage means that is electrically coupled to the electronic processing board, wherein the electronic processing board is arranged to store the ticket data in the memory.

According to another aspect of the invention there is provided an apparatus for use with a gaming machine, the apparatus comprising:

an electronic processing board;

a first data interface that is electrically coupled to the electronic processing board;

a second data interface that is electrically coupled to the electronic processing board; and a ticket reader that is electrically coupled to the electronic processing board, wherein the electronic processing board is arranged to:

communicate with the ticket reader in order to obtain ticket data that is associated with a ticket that is inserted into the ticket reader;

communicate with a computer system, which is remote to the gaming machine, via the second data interface so as to: provide the computer system with the ticket data; and to receive from the computer system information about wagerable credits associated with the ticket data; and communicate with the gaming machine via the first data interface in order to add the wagerable credits to the gaming machine.

In an embodiment of the invention the apparatus comprises a visual display that is electrically coupled to the electronic processing board, wherein the electronic processing board is arranged to communicate with the visual display device to display information in response to the ticket being inserted into the ticket reader.

In an embodiment of the invention the electronic processing board is arranged to use a predefined electronic funds transfer protocol in order to communicate with the gaming machine via the first data interface to add the wagerable credits to the gaming machine.

In an embodiment of the invention the apparatus comprises a memory storage means that is electrically coupled to the electronic processing board, wherein the electronic processing board is arranged to store the ticket data in the memory.

It will also be appreciated that in the claims which follow and in the description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

DETAILED DESCRIPTION OF THE PREFERRED EMBODIMENT

Figure 1:
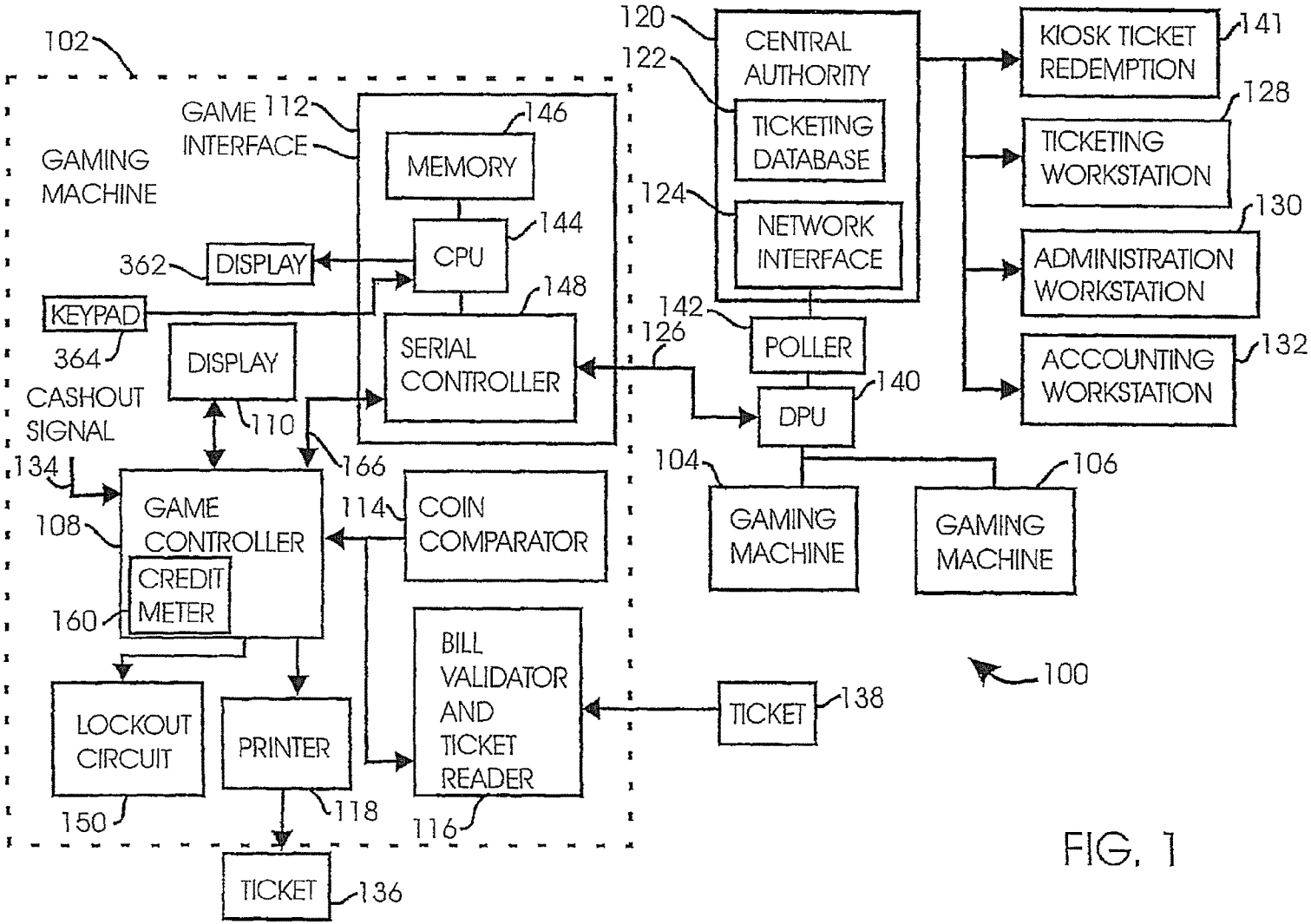
FIG. 1 illustrates a block diagram of a gaming system using the present invention.

Referring to FIG. 1, a gaming network 100 includes several gaming machines 102, 104, 106. The gaming machines 102-106 may be implemented, for example, as slot machines, video poker machines, video roulette machines, and the like. Each gaming machine 102-106 includes a game controller 108, a display 110, and a game network interface 112. The game interface 112 may be, for example, and RS485 interface such that implemented by Sentinel™ Interface from Casino Data Systems. Other interfaces and network architectures (e.g. Ethernet, parallel port, and the like) may be substituted however. Furthermore, the game interface 112 may adhere to, for example, the IGT Gaming SAS™ communication protocol, the CDS GDAP™ communication protocol, a custom protocol, or another third party communication protocol for establishing and maintaining communication with the gaming machine 102. The game interface 112 is physically present inside of the gaming machine 102; although, it may be located externally from and coupled to the gaming machine 102. Each gaming machine 102-106 further includes a coin acceptor or comparator 114, a bill validator/ticket reader 116, and a ticket printer 118.

Gaming machine 102 may be originally manufactured with some or all of these components, or may be retrofitted with some or all of these components, as described below. Initially, the embodiment of FIG. 1 will be described as if the bill validator/ticket reader 116 and ticket printer 118 are originally manufactured within the gaming machine.

The game controller 108 is responsive to a cashout signal 134 to print a ticket 136 on paper, or other suitable material. Additionally, previously printed tickets (e.g., the ticket 138) may be redeemed for credits by the gaming machines 102-106. The gaming network also includes a central authority or host computer system 120. The central authority 120 includes a ticketing database 122 and a network interface 124 for connection over the network medium 126 to the gaming machines 102-106. Support systems connect to the central authority 120, including a ticketing workstation 128, an administration workstation 130, and an accounting workstation 132.

A dataport unit (DPU) 140 is provided as a data concentrator and buffering communication unit to address multiple gaming machines and to communicate with the poller 142. The poller 142, in turn, communicates with the DPU 140 and the central authority 120. The game interface 112 may be generally configured as shown in FIG. 1 to include a CPU 144, a program and data memory 146, and a serial controller 148.

The game controller 108 is responsible for operation of the gaining device 102. Thus, the game controller 108 may include a microprocessor, memory, game software, and support circuitry to implement a slot machine or other type of game. The display 110 presents to the player a representation of the pending credit in the gaming machine 102 (e.g., $455.50). During play, the game controller 108 tracks the pending credit according to the rules of the game and the interaction with the player (including the deposit of additional funds via the coin acceptor 114 and bill validator 116), and further monitors for assertion of the cashout signal 134. Thus, the central authority 120 need not monitor the pending credit in each gaming machine 102-106, as each gaming machine 102-106 preferably tracks the pending credit locally and independently of the central authority 120.

In response to the cashout signal 134, the game controller 108 prints the ticket 136 which may be redeemed later at gaming machines 102-106 or at independent workstations with ticket readers. The cashout signal 134 may be generated by a player actuated switch, touchscreen input, or the like. As will be explained in more detail below, the game controller 108 prints the ticket 136 with a pre-loaded ticket validation number obtained from the central authority 120 through the network interfaces 112, 124 and over the network medium 126. The central authority 120 may use a number generator to generate validation numbers, and, if desired, may use an encryption algorithm to generate the validation numbers. The number generated may be based on, for example, the time and/or date as well as the gaming machine number.

The ticketing database 122 stores information obtained from the gaming machines 102-106, as well as locally generated validation numbers. The ticketing workstation 128 provides cash redemption of tickets separate from the gaming machines, the administration workstation 130 provides an interface for setting up system parameters, and the accounting workstation 132 provides for ticket and gaming machine accounting functions. Note that in general, when a ticket validation number is pre-loaded into a game interface 112, the ticket validation number is also stored in ticketing database 122 (albeit without an associated pending credit amount). Thus, should the gaming network fail, validation may still occur through human intervention.

Figure 2:
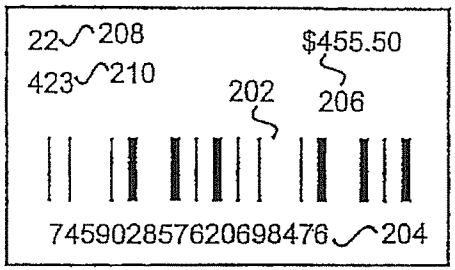
FIG. 2 shows a front view of a ticket used with the gaming system of FIG. 1.

Turning next to FIG. 2, a ticket 200 includes a validation number bar code 202 (e.g., in JCM or Code 205 format), a human intelligible validation number 204, and a human intelligible pending credit amount 206. The ticket 200, as shown, also includes a machine number 208 and a ticket number 210 (e.g., a sequential ticket number generated in the gaming machine 102). The validation number bar code 202 is a machine readable representation of a pre-loaded validation number (as discussed in more detail below) but the validation number bar code 202 generally does not encode other information (e.g., the pending credit amount). In other words, the ticket 200, when it is advantageous to do so, may omit a machine readable pending credit amount. Additional information may also be printed on the ticket 200, including a date/time of cashout, casino name, ticket expiration date, and the like.

In using the system of FIG. 1, a player presses a cashout button and thereby generates the cashout signal 134. In response to the cashout signal 134, game controller 108 proceeds to obtain a pre-loaded validation number from the game interface 112 and to print ticket 136. The game controller 108 sends the necessary information to ticket printer 118 and the ticket is printed.

Information regarding the printed ticket is sent to the central authority 120 through the game interface 112. The printed ticket information may include the casino name, ticket date and time, validation number, a bar code representing the validation number, a numeric pending credit amount, an alphanumeric description of the pending amount, a machine number, and a ticket number (typically up to 9999 and sequentially generated at each gaming machine). The game interface 112 also requests a new ticket validation number from the central authority 120, and pre-loads it into a memory (e.g., the memory 146) for use when the next ticket is printed. Thus, a ticket validation number is immediately available at the gaming machine when the player activates the cashout button.

The ticketing database 122 in the central authority may store, for example, a number of fields as desired. Examples of fields are set forth in Tables 1, 2 and 3 of parent application Ser. No. 09/693,483, the entirety of such application is incorporated herein by reference.

Also, in using the system in FIG. 1, a player may insert a ticket into a gaming machine 102-106. The gaming machine queries the central authority 120 for validation of the validation number bar code 202 printed on the ticket. In general, the pending credit printed on the ticket is not read by the ticket reader. Rather, the system itself responds with the pending credit as explained below.

The central authority attempts to find the validation number in its ticketing database 122. If the validation number is not found, the system responds to the gaming machine with a Reject Message. If the ticket is a duplicate, i.e., it has been validated earlier, the system also responds with a Reject Message. If the validation number is not a duplicate, then the system determines whether the ticket status as recorded in the ticketing database 122 is issued and redeemable (i.e., it has not already been redeemed for money). If not, the system again responds with a Reject Message. The ticket/bill validator 116 then rejects the ticket, i.e., returns the ticket to the player.

If the ticket is valid, the central authority responds to the gaming machine via the game interface 112 to indicate that the ticket is valid and provides the amount to be credited (e.g., in cents). The gaming machine loads the amount into its credit meter.

Subsequently, the gaming machine replies to the central authority with the ticket processing result (e.g., the ticket was rejected or accepted). The central authority changes the ticket status in the ticketing database 122 to indicate, for example, that the ticket has been redeemed.

Figure 3:
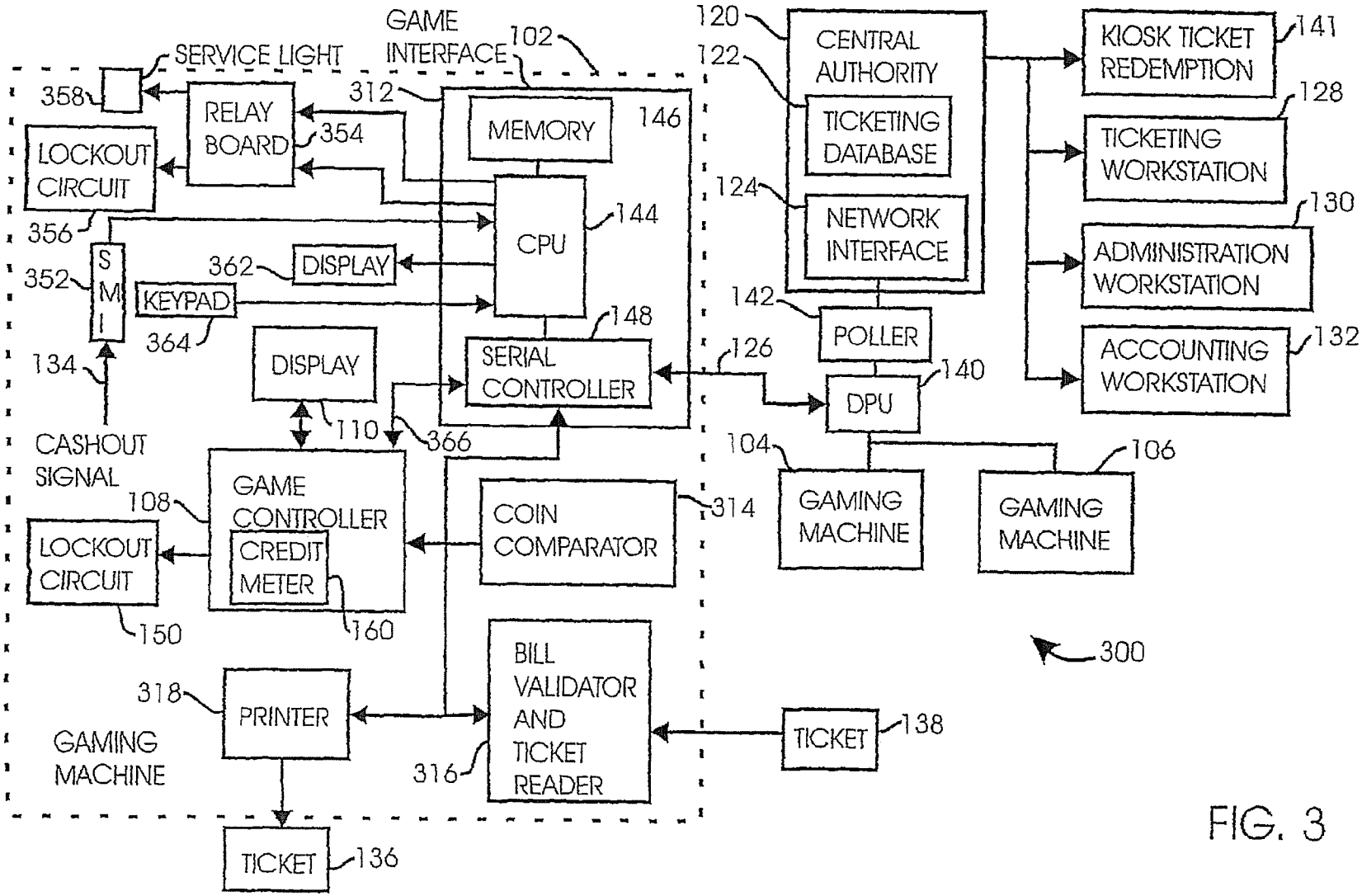
FIG. 3 illustrates a block diagram of a gaming system in which a central authority or game interface exercises direct control over a bill validator, a ticket printer, and a ticket reader of the individual gaming machine.

With reference next to FIG. 3, a block diagram of a gaming network 300 illustrates control by central authority 120 over a coin acceptor 314, a bill validator and ticket reader 316, and a ticket printer 318. As will suggest itself, a separate ticket reader and ticket printer may be used, however the functionality of a reader and printer may be incorporated into a single device. FIG. 3 is similar to FIG. 1, and like reference numerals denote like parts. Note, however, that the coin comparator 314, bill validator and ticket reader 316, and ticket printer 318 are connected directly to the game interface 312 rather than to the game controller 108.

As a result, the central authority 120 may exercise control over the coin acceptor 314, bill validator and ticket reader 316, and ticket printer 318 through the game interface 312. The game controller 108 is thereby relieved of those duties. Furthermore, pre-existing gaming machines that do not allow convenient game controller ticket printing and reading, may nevertheless issue and redeem tickets when retrofitted with the game interface 312, bill validator and ticket reader 316 and ticket printer 318. In such a retrofit, the coin comparator 314 is connected to game interface 312.

Interface 312 includes software in its memory 146 to directly control ticket printer 318 as well as coin acceptor 314 and bill validator and ticket reader 316, and to correspondingly communicate with central authority 120, as described herein. The hardware components of interface 312 may be incorporated onto a single printed circuit board (or several boards, if desired) which is fitted into gaming machine 102. The printed circuit board may replace an existing machine's original interface board so as to retrofit the existing machine to provide ticketing capabilities. Thus, an existing machine gains the ability to print and redeem tickets. As will suggest itself, apertures may be cut out of the face of the gaming machine in order to locate the typical ticket receiving slot of bill validator and ticket reader 316 and to locate the typical dispensing slot of ticket printer 318. Instructional information may also be printed on the face of the gaming machine, if desired.

Game interface 312 controls the physical cashout button on the gaming machine. As shown in FIG. 3, the cashout signal, generated by activation of the cashout button, is sent to the game controller 108 which in turn communicates this event to game interface 312. Alternatively, the cashout signal 134 may bypass game controller 108 and be sent directly to game interface 312.

When a player presses the cashout button, credits are removed from the game credit meter, a validation number is assigned to a ticket, information is logged into the database 122 and the ticket 136 is printed. Electronic Funds Transfer (EFT) protocols are used to remove all player credits from the gaming machine.

The game interface 312 stores a pre-loaded ticket validation number obtained from the central authority 120, as described above in reference to FIG. 1. It is this pre-loaded validation number that is printed on the ticket. Alternatively, game interface 312 may independently generate the validation number by a number generator as previously discussed. Interface 312 may preload its memory 146 with the number generated.

Upon actuation of the cashout button, a validation number, as well as other information, is sent by game interface 312 to the ticket printer 318 and to the ticketing database 122. Other information sent may include machine number, sequential ticket number, amount, date/time, and expiration date. A ticket similar to that shown in FIG. 2 is then printed. Ticketing database 122 will then have information regarding the particular ticket that may later be used to validate it.

The flow of the process for printing tickets may be described as follows:

1. A player pushes the cashout button on gaming machine 102. The cashout signal 134 is generated and sent to game interface 312.

2. The game interface 312 responds to the cashout signal by removing all credits from the credit meter using EFT protocol. An EFT message is sent by game interface 312 to the game controller 108 to cause the removal of all credits. As will be understood, gaming machine 102 has EFT protocol capabilities.

3. The game interface 312 also provides a validation ticket number and the credit amount to the printer. The validation number is preloaded into interface 312 after generation by the central authority 120. Alternatively, game interface 312 may generate the validation number independently of the central authority, and provide data regarding that generation to the central authority for storage in database 122.

4. Ticket printer 318 prints a ticket and dispenses the ticket to the player.

5. Data is stored in game interface 312 regarding the printing. Game interface 312 may keep a log of all printed tickets with date and time data, and may keep another log as to printer events.

6. Game interface 312 sends data to central authority 120 regarding the printing, i.e., that the ticket was successfully printed, and a record of the ticket is sent as well.

7. Central authority 120 generates the next validation number to be used by that gaming machine and loads that validation number into game interface 312.

When a ticket 138 is inserted into the bill validator and ticket reader 316, the game interface 312 reads the ticket directly and proceeds to verify the validation number bar code with the central authority 120 as explained above. Valid tickets result in credit being applied to the gaming machine 102 using, for example, an Electronic Funds Transfer (EFT) message. The EFT message may be generated by the central authority. An invalid ticket is rejected, and is returned to the player. In addition, the game interface 312 may also read standard currency (e.g., bills and coins) input to coin comparator 314 and bill validator 316, and appropriately report to the central authority 120. Again, the central authority 120 may respond with an EFT message to the gaming machine 102 to apply credit thereto. Alternatively, the game interface 312 may determine the amount of standard currency inserted and report that amount directly to the gaming machine 102 via an EFT message (to appropriately increment its bill and coin meters). Gaming interface 312 may log the bill and coin amounts into memory. In that regard, the game interface 312 may act as a filter, such that only printed tickets generate appreciable network traffic to the central authority 120.

The flow of the process for redeeming tickets may be described as follows:

1. A player inserts a ticket into the bill validator and ticket reader 316.

2. The game interface 312 responds by storing pertinent data and transmitting the ticket's validation number to the central authority 120.

3. Central authority 120 checks its database 122 to determine whether the validation number exists in the database, whether the ticket is a duplicate, and the status of the ticket. If valid, the central authority changes the ticket's status to indicate redemption is in process and then sends the ticket type (cashable) and the amount (cents) to the game interface 312.

4. The game interface 312 tells the ticket reader 316 that the ticket is acceptable and data is stored accordingly. The ticket reader 316 retains the ticket.

5. The game interface 312 sends a message to the game via EFT protocol and stores data accordingly.

6. The game controller 108 responds to the EFT message and loads an amount into the credit meter which is displayed at display 110. The game controller 108 may store data and informs interface 312 that credit has been given to the player.

7. The game interface 312 sends data to central authority 120 that the ticket was redeemed.

8. The central authority 120 changes the ticket status to redeemed.

If the ticket is not accepted by the game, the central authority is notified accordingly so that it may change its database to reflect the status of the ticket. If the game is able to accept some, but not all of the ticket amount, the game is able to print a ticket for the difference in order to give "change" back to the player. Some gaming machines can only accept whole dollar amounts, based on the gaming machine's denomination. The game interface 312 may print a change ticket to return the change balance to the player. Game interface 312 prints the change ticket in the same manner it prints a cashout ticket, but using a validation number and communicating with the central authority, as described above. Data is stored in the central authority, accordingly.

Thus, the present invention provides a secure ticket actuated gaming network. In particular, the gaming machines are pre-loaded with ticket validation numbers in preparation for printing a cashout ticket. As a result, the player need not wait while the gaming machine generates or requests a new validation number. Preexisting machines may be retrofit to participate in the ticketing process.

A retrofit kit may be used to retrofit preexisting gaming machines. As used herein, "retrofit" means to furnish a preexisting machine or system with additional parts, either new parts or used parts. A retrofit kit includes a game interface, a ticket printer and a bill validator and ticket reader. The game interface may include a four port serial I/O Board which connects the serial port of the interface to the ticket printer and bill validator and ticket reader. The game interface will also include the necessary software to perform its functions as described above. As will suggest itself, additional software may be provided so as to permit game interface 312 to display messages on display 110. For example, the message ADDING CREDITS may be displayed to ensure player awareness during the validation process. Other messages may include TICKET ACCEPTED or TICKET REJECTED.

While the invention has been described with reference to particular embodiments, those skilled in the art will understand that various changes may be made and equivalents may be substituted without departing from the scope of the invention. In addition, many modifications may be made to adapt a particular step, structure, or material to the teachings of the invention without departing from its scope. Therefore, it is intended that the invention not be limited to the particular embodiments disclosed, but that the invention will include all embodiments falling within the scope of the appended claims.

The invention claimed is:

1. An apparatus for use with a gaming machine, the apparatus comprising:

an electronic processing board that is external to the gaming machine, the electronic processing board including a board controller separate from a game controller of the gaming machine;

a first data interface that is electrically coupled to the electronic processing board for communication between the board controller and the game controller;

a second data interface that is electrically coupled to the electronic processing board for communication between the board controller and a remote computer system remote to the gaming machine; and a ticket printer external to the gaming machine that is electrically coupled through a direct physical connection to the electronic processing board, wherein the electronic processing board isolates the ticket printer from direct operational control by the game controller, wherein the electronic processing board is arranged to perform the following steps in response to a cashout signal:

communicate with the game controller via the first data interface to effect a removal of wagerable credits from the gaming machine;

communicate with the remote computer system, via the second data interface so as to:

provide the remote computer system with details of the removal of the wagerable credits;

receive from the remote computer system ticket data that is associated with the removal of the wagerable credits; and communicate with the ticket printer to direct the ticket printer to issue a ticket that is associated with the ticket data.

2. The apparatus as claimed in claim 1, further comprising a visual display that is electrically coupled to the electronic processing board, wherein the electronic processing board is arranged to communicate with the visual display to display information in response to the cashout signal.

3. The apparatus as claimed in claim 1, wherein the electronic processing board is arranged to receive the cashout signal from the gaming machine via the first data interface.

4. The apparatus as claimed in claim 1, wherein the electronic processing board is arranged to use a predefined electronic funds transfer protocol in order to communicate with the gaming machine via the first data interface to effect the removal of wagerable credits from the gaming machine.

5. The apparatus as claimed in claim 1, and further comprising a memory storage that is electrically coupled to the board controller of the electronic processing board, wherein the board controller is arranged to store the ticket data in the memory storage.

6. An apparatus for use with a gaming machine, the apparatus comprising:

an electronic processing board that is external to the gaming machine, the electronic processing board including a board controller separate from a game controller of the gaming machine;

a first data interface that is electrically coupled to the electronic processing board for communication between the board controller and the game controller;

a second data interface that is electrically coupled to the electronic processing board for communication between the board controller and a remote computer system remote to the gaming machine; and a ticket reader external to the gaming machine that is electrically coupled through a direct physical connection to the electronic processing board, wherein the electronic processing board isolates the ticket reader from direct operational control by the game controller, wherein the electronic processing board is arranged to:

provide communication between the board controller and the ticket reader in order to obtain ticket data that is associated with a ticket that is inserted into the ticket reader;

communicate with the remote computer system, via the second data interface so as to:

provide the remote computer system with the ticket data; and receive from the remote computer system information about wagerable credits associated with the ticket data; and communicate with the game controller via the first data interface in order to add the wagerable credits to the gaming machine.

7. The apparatus as claimed in claim 6, further comprising a visual display that is electrically coupled to the electronic processing board, wherein the electronic processing board is arranged to communicate with the visual display to display information in response to the ticket being inserted into the ticket reader.

8. The apparatus as claimed in claim 6, wherein the electronic processing board is arranged to use a predefined electronic funds transfer protocol in order to communicate with the gaming machine via the first data interface to add the wagerable credits to the gaming machine.

9. The apparatus as claimed in claim 6, further comprising a memory storage that is electrically coupled to the board controller, wherein the electronic processing board is arranged to store the ticket data in the memory storage.

* * * * *

UNITED STATES PATENT AND TRADEMARK OFFICE

CERTIFICATE OF CORRECTION

PATENT NO. : 8,678,911 B2
APPLICATION NO. : 12/323230
DATED : March 25, 2014
INVENTOR(S) : Van Baltz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 856 days.

Signed and Sealed this
Eleventh Day of August, 2015

Michelle K. Lee

Michelle K. Lee
*Director of the United States Patent and Trademark Office*